US008556113B2

(12) United States Patent
Pounder et al.

(10) Patent No.: US 8,556,113 B2
(45) Date of Patent: Oct. 15, 2013

(54) LID ADAPTER

(75) Inventors: Joseph R. Pounder, Greenville, WI (US); Shawn A. Oakes, Ripon, WI (US); Margaret P. Hoks, Neenah, WI (US); Ann M. Andres, Neenah, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 38 days.

(21) Appl. No.: 13/241,372

(22) Filed: Sep. 23, 2011

(65) Prior Publication Data

US 2012/0145728 A1 Jun. 14, 2012

Related U.S. Application Data

(60) Provisional application No. 61/421,909, filed on Dec. 10, 2010.

(51) Int. Cl.
*B65D 51/00* (2006.01)
*B65D 41/00* (2006.01)

(52) U.S. Cl.
USPC ..... 220/643; 220/23.83; 220/23.86; 220/287; 215/43; 215/45

(58) Field of Classification Search
USPC ..... 220/23.2, 23.4, 23.83, 23.86, 287, 643, 220/720; 215/43, 45, 319
See application file for complete search history.

(56) References Cited

U.S. PATENT DOCUMENTS

| | | | | |
|---|---|---|---|---|
| 3,956,550 | A | 5/1976 | Sutch | |
| 4,094,460 | A | 6/1978 | Scanga et al. | |
| 4,130,234 | A | 12/1978 | Schmidt | |
| 4,238,047 | A | 12/1980 | Helms et al. | |
| 4,305,771 | A | 12/1981 | McLaren | |
| 4,342,183 | A | 8/1982 | Gordon et al. | |
| 4,961,521 | A | 10/1990 | Eckman | |
| 5,553,731 | A | 9/1996 | Schuyler | |
| 6,415,937 | B1 * | 7/2002 | DeJong et al. | 215/386 |
| 6,578,726 | B1 | 6/2003 | Schaefer | |
| 6,852,381 | B2 | 2/2005 | Debraal et al. | |
| 7,520,404 | B2 | 4/2009 | Mazzarolo | |

(Continued)

FOREIGN PATENT DOCUMENTS

| | | | |
|---|---|---|---|
| EP | 1716049 | B1 | 7/2011 |
| JP | 56062131 | A | 5/1981 |

(Continued)

OTHER PUBLICATIONS

International Search Report and Written Opinion of the International Search Authority for PCT/US2011/052934, mailed Apr. 26, 2012.

*Primary Examiner* — Anthony Stashick
*Assistant Examiner* — Madison L Poos
(74) *Attorney, Agent, or Firm* — William W. Letson

(57) ABSTRACT

Embodiments of the invention provide an adapter suitable for use with cups and lids. In some embodiments, the adapter is designed so that a single lid with a predetermined diameter fits, by way of the adapter, with paper cups of different diameters. In some embodiments, an adapter including an inner diameter that corresponds to the upper diameter of the paper cup cooperates with the upper portion of the cup. The adapter also includes an outer diameter that corresponds to the predetermined diameter of the lid to ensure a secure fit between that particular sized cup and the plastic lid having a predetermined diameter.

20 Claims, 6 Drawing Sheets

(56) References Cited

U.S. PATENT DOCUMENTS

| | | | |
|---|---|---|---|
| 7,968,033 | B2 | 6/2011 | Mazzarolo |
| 8,042,356 | B2 | 10/2011 | Norris et al. |
| 8,444,902 | B2 | 5/2013 | Middleton et al. |
| 2004/0262322 | A1 | 12/2004 | Middleton et al. |
| 2005/0236413 | A1 | 10/2005 | Maciag et al. |
| 2006/0201946 | A1 | 9/2006 | Witt |
| 2007/0210091 | A1 | 9/2007 | Mazzarolo |
| 2010/0147447 | A1 | 6/2010 | Mazzarolo |
| 2010/0288768 | A1 | 11/2010 | Booth |
| 2010/0288827 | A1 | 11/2010 | Booth |
| 2011/0108553 | A1 | 5/2011 | Pantelleria |
| 2012/0125990 | A1 | 5/2012 | Lin |
| 2012/0241462 | A1 | 9/2012 | Lin |
| 2012/0318858 | A1 | 12/2012 | Lin |

FOREIGN PATENT DOCUMENTS

| | | | |
|---|---|---|---|
| JP | 2000335550 | A | 12/2000 |
| JP | 2005263295 | A | 9/2005 |
| JP | 3153078 | U3 | 8/2009 |
| KR | 20020054070 | A | 7/2002 |
| KR | 200200554070 | A | 7/2002 |
| WO | 2009086501 | A2 | 7/2009 |
| WO | 2012/059140 | A1 | 5/2012 |

* cited by examiner

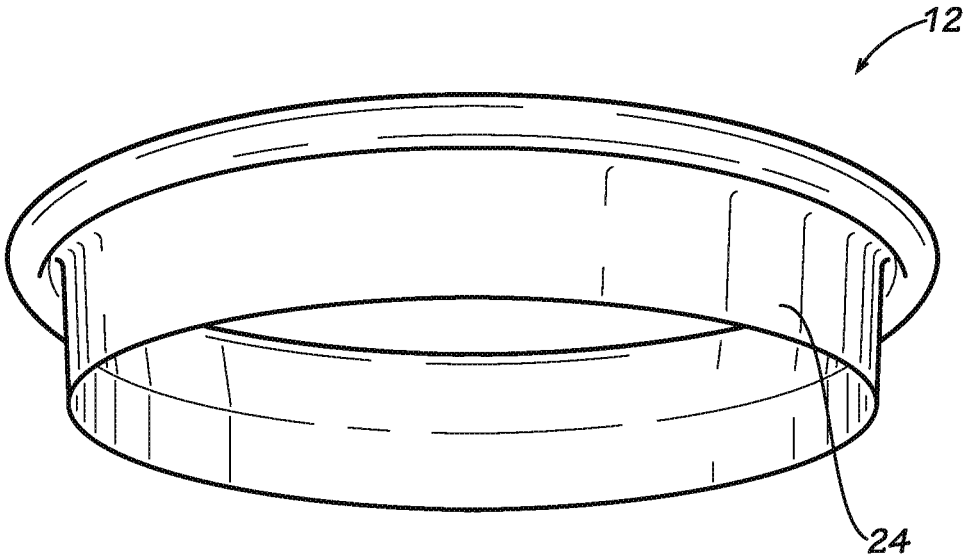
FIG. 2
FIG. 3
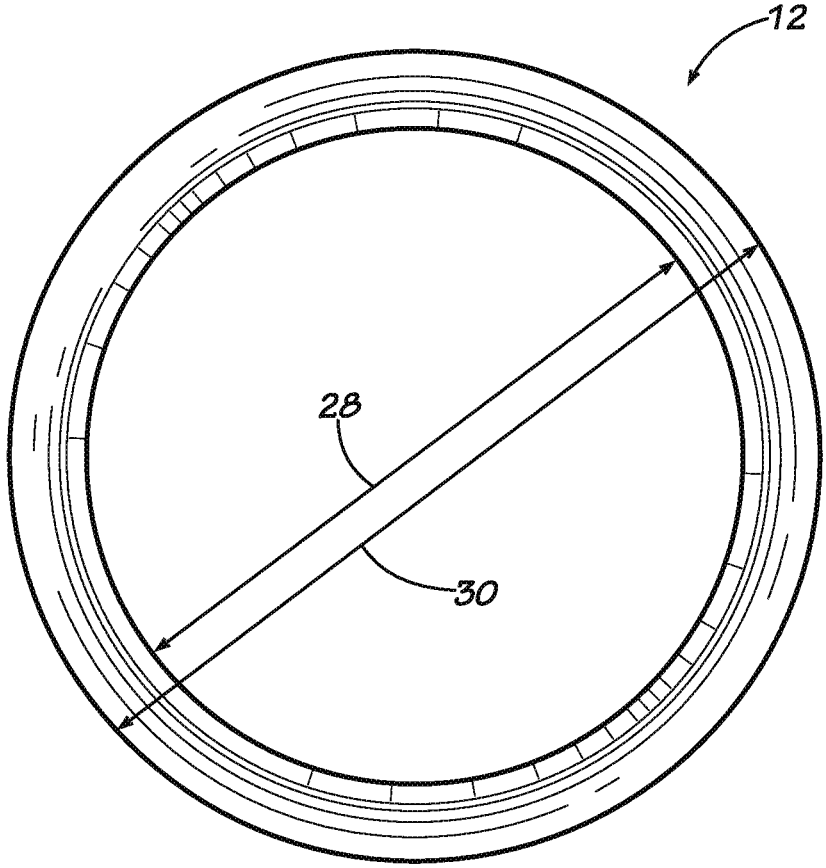

LID ADAPTER

RELATED APPLICATIONS

This applications claims the benefit of U.S. Ser. No. 61/421,909 filed Dec. 10, 2010 and titled "Lid Adapter," the contents of which are hereby incorporated by reference.

FIELD OF THE INVENTION

This invention relates generally to adapters for facilitating the interaction of a cup with a lid and to methods of manufacturing such adapters.

BACKGROUND OF THE INVENTION

The manufacture of paper cups begins with rolls of paperboard stock. In some embodiments, the stock is generally first printed with any graphics or printing that will appear on the finished cup. The printed stock is then coated with polyethylene. Only the inside surfaces are coated if the cup is intended for use with hot liquids. Both the inside and outside surfaces are coated if the cups are intended for use with cold liquids. Coating the outside of cold liquid cups prevents condensation that forms on the outside of the cup from soaking into the paperboard.

After printing and coating, the paperboard stock is die cut into blanks that will become the cup wall. Each blank is then wound around a tapered mandrel to form the cup wall and overlapping wall edges are bonded with heat and pressure.

Disks for the cup bottoms are die cut from (typically unprinted) paperboard stock, and a disk is pressed into the smaller diameter of each cup wall and sealed in place with heat and pressure. In some instances, the upper edge of the cup is rolled into a lip.

Plastic lids are sized and shaped to interact with the upper edge of the paper cups so that a lid of a particular diameter is required to fit a cup having a corresponding upper diameter. Therefore, establishments supplying different sized cups also must supply lids having diameters corresponding to each cup size. This leads to establishments having an increased number of stock keeping units (SKUs) associated with the various sized lids and the various sized cups.

Moreover, the fit between conventional paper cups and plastic lids is not always consistent and/or secure, which can lead to leakage between the cup and the lid and can also result in the lid popping off of the paper cup. This is particularly the case as the paper cup loses its rigidity with use (and sometimes becomes soggy). Although a plastic cup fitted with a plastic lid results in a more consistent fit than a paper cup fitted with a plastic lid, plastic cups are more expensive to manufacture.

SUMMARY OF THE INVENTION

Embodiments of the invention provide an adapter suitable for use with cups and lids. In some embodiments, the cup is made of paperboard. In some embodiments, the lid and the adapter are made of plastic, which forms a better seal between the lid and the adapter than a conventional plastic lid and a paper cup. In some embodiments, the plastic lid and adapter provides a more rigid, stable cup that is less susceptible to leakage.

In some embodiments, the adapter is designed so that a single lid with a predetermined diameter fits, by way of the adapter, with paper cups of different diameters. Specifically, in some embodiments, an adapter including an inner diameter that corresponds to the upper diameter of the paper cup cooperates with the upper portion of the cup. In some embodiments, the adapter is affixed to, molded to, bonded to, located at, thermoformed to, or otherwise secured to the upper portion of the cup. The adapter also includes an outer diameter that corresponds to the predetermined diameter of the lid, which ensures a secure fit between that particular sized cup and the plastic lid having a predetermined diameter. In this way, the inner diameter of the adapter varies to fit a particular sized cup, while the outer diameter of the adapter remains generally the same to fit single sized lids having a predetermined diameter.

Accurate and complete understanding of the way in which this invention works is not necessary to practice the invention, and Applicants do not wish to be bound by the forgoing or any other understanding of how their invention or any of the prior art works.

BRIEF DESCRIPTION OF THE DRAWINGS

FIG. 2 is a perspective view of the adapter of FIG. 1.

FIG. 3 is a top plan view of the adapter of FIG. 1.

DETAILED DESCRIPTION

Figure 1:
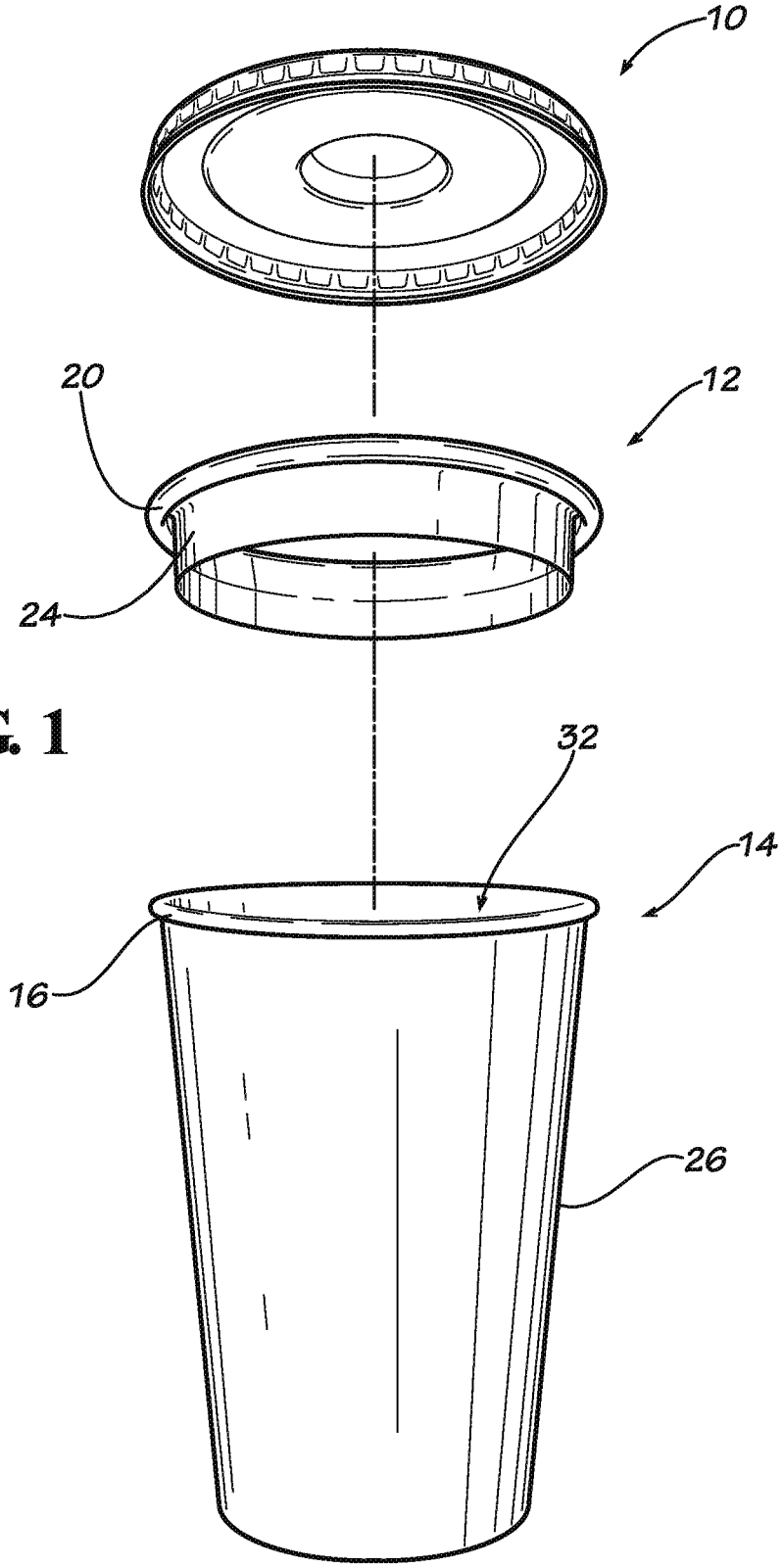
FIG. 1 is an exploded perspective view of a lid, adapter, and cup according to one embodiment of the invention.

FIG. 1 illustrates a cup assembly comprising a lid 10, an adapter 12, and a cup 14. In some embodiments, the lid 10 and the adapter 12 are formed of plastic materials, while the cup 14 is formed of paperboard stock. In other embodiments, the cup 14 is formed of plastic or other suitable materials. In some embodiments, the adapter 12 is formed of polyethylene, polypropylene, polylactic acid (PLA), polyethylene terephthalate (PET), or any other suitable biodegradable or non-biodegradable material.

Figure 4:
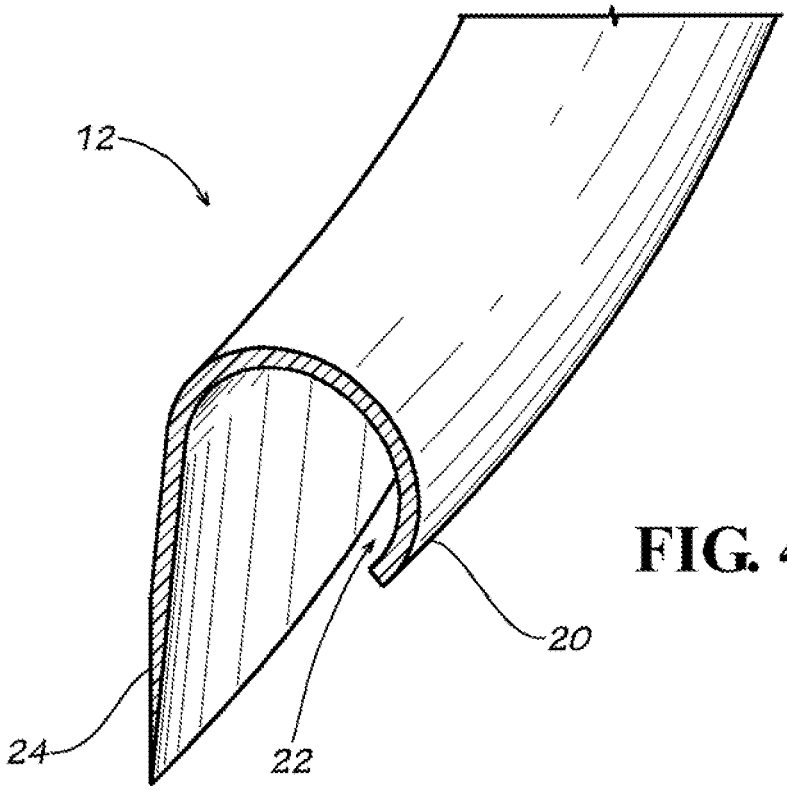
FIG. 4 is a partial, perspective cross-sectional view of the adapter of FIG. 1.
Figure 5:
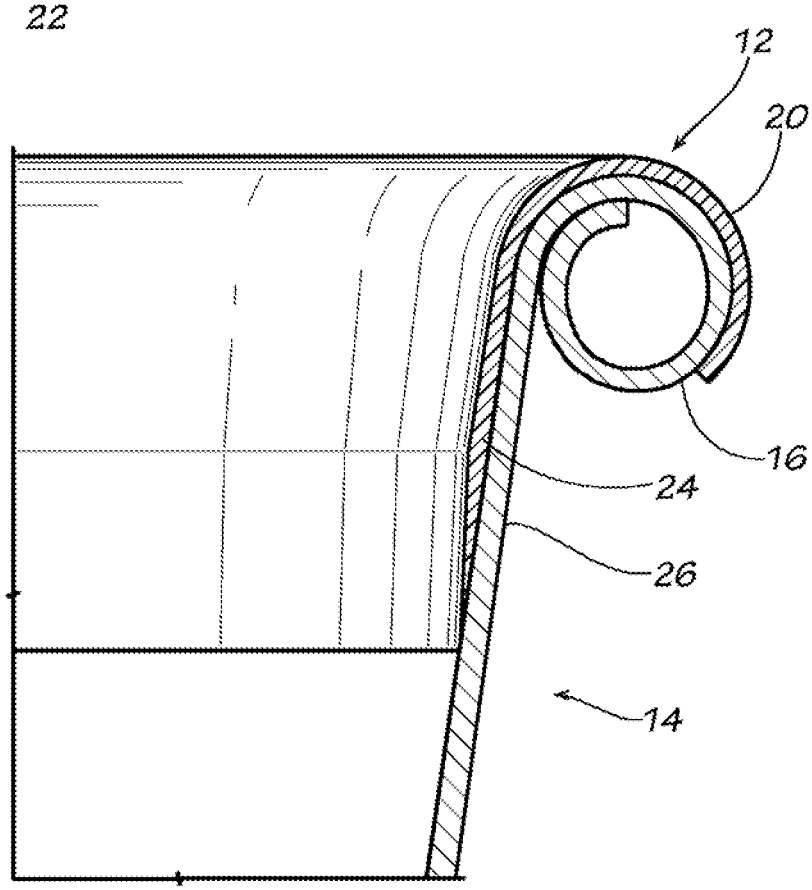
FIG. 5 is a cross-sectional plan view of the adapter of FIG. 1 interfitted with a cup.
Figure 10:
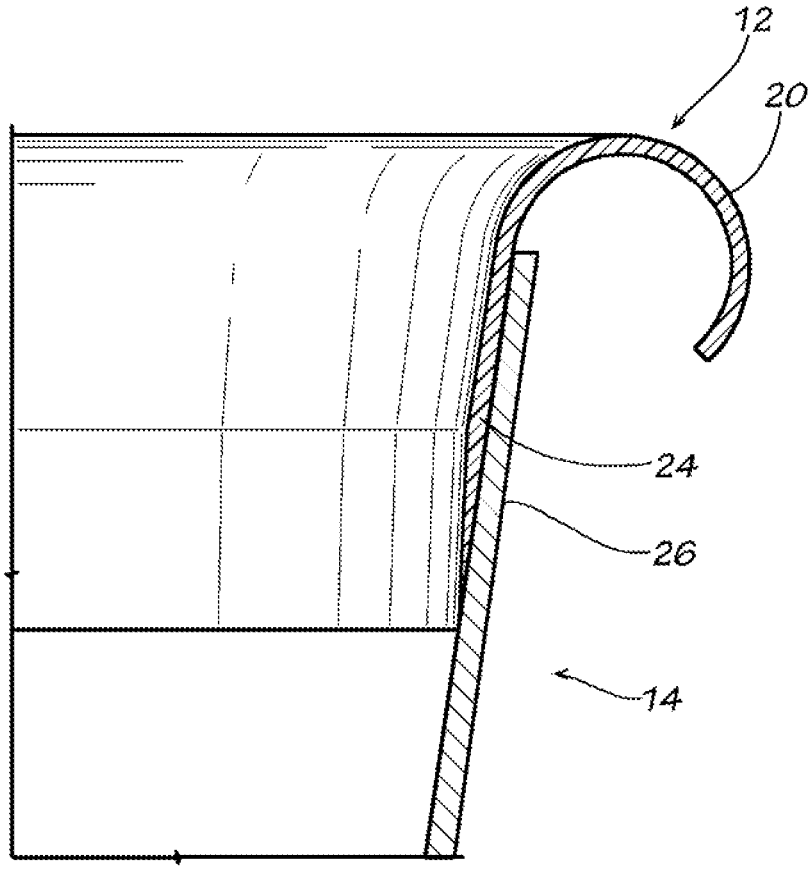
FIG. 10 is a cross-sectional plan view of the adapter of FIG. 1 interfitted with a cup with an uncurled brim.

In the embodiment shown in FIG. 1, cup 14 includes wall 26 and an optional brim 16, which, if present, extends around the periphery of the upper portion of the wall 26. The adapter illustrated in FIGS. 1-3 includes a base portion 24 and a ledge 20 that extends around the upper periphery of the adapter 12. A gap 22 (shown in FIG. 4) is formed between the base portion 24 and the ledge 20 of the adapter. Gap 22 may be shaped and sized to accommodate the brim 16 of the cup 14, as shown in FIG. 5. In some embodiments, the gap 22 is shaped and sized relative to the brim 16 of the cup so that a tight seal is formed between the adapter and the brim 16 of the cup 14 to prevent leakage and to prevent the adapter from popping off the cup during use. Adapter 12 may also be used with brimless cups, as shown in FIG. 10.

As shown in FIG. 3, adapter 12 includes an inner diameter 28 and an outer diameter 30. The inner diameter 28 is slightly smaller than the diameter of the opening 32 (FIG. 1) formed at the upper portion of the cup 14 so that the base portion 24 of the adapter 12 fits snuggly within the cup 14. In the embodiment shown in FIGS. 1-5, base portion 24 is tapered to correspond to the geometry of the inside of the cup wall to help prevent leakage. In other embodiments, base portion 24 is not tapered.

The outer diameter 30 of adapter 12 is slightly smaller than the inner diameter of lid 10 so that the ledge 20 of the adapter 12 is configured to fit snuggly within lid 10. In some embodiments, the outer diameter 30 is measured with respect to the ledge 20 of the adapter 12. Moreover, the ledge 20 of the adapter 12 is sized to correspond to the inner diameter of lid 10 so that lid 10 forms a tight seal with ledge 20 to prevent leakage and to prevent the adapter from popping off the cup during use. Because the adapter 12 and lid 10 are both formed of plastic materials in some embodiments, a secure fit is achieved between the two pieces. Moreover, plastic materials maintain their durability with use as compared with paper materials, so the added rigidity of a plastic adapter and lid maintains the rigidity of the cup assembly if the cup 14 gets wet or is used for extended periods of time.

In some embodiments, the adapter 12 is molded to the cup 14 as part of the cup assembly process. In other embodiments, the adapter is affixed to, bonded to, located at, thermoformed to, or otherwise secured to the upper portion of the cup by any suitable mechanism. In some embodiments, the adapter is molded to the cup by heat sealing to the inside of the cup. Presealing the adapter to the cup helps prevent leaks between the adapter and the cup.

In some embodiments, before the cup is formed, an upper portion of the paperboard stock that forms the cup is coated with a material that is compatible with the material of adapter 12. In this way, when the adapter is situated adjacent to the coated material and the assembly is heated, the adapter and the cup are formed together as one piece. In turn, in this embodiment, the adapter and cup cannot be separated from one another once formed, which prevents the adapter from "popping" off the cup during use. In certain embodiments, the material of the adapter and the material of the coating of the paperboard stock are the same so that heating of the two serves as a glue that joins the two components together.

In other embodiments, heat is not necessary to secure the adapter to the cup. As an alternate (or in addition) to heat, the size and geometry of the base portion of the adapter is configured to correspond to the size and geometry of the upper portion of the cup so that a tight fit is achieved between the two pieces. In other embodiments, glue or another suitable adhesive is used to secure the adapter and the cup together in lieu of, or in addition to, the use of heat.

Figure 6:
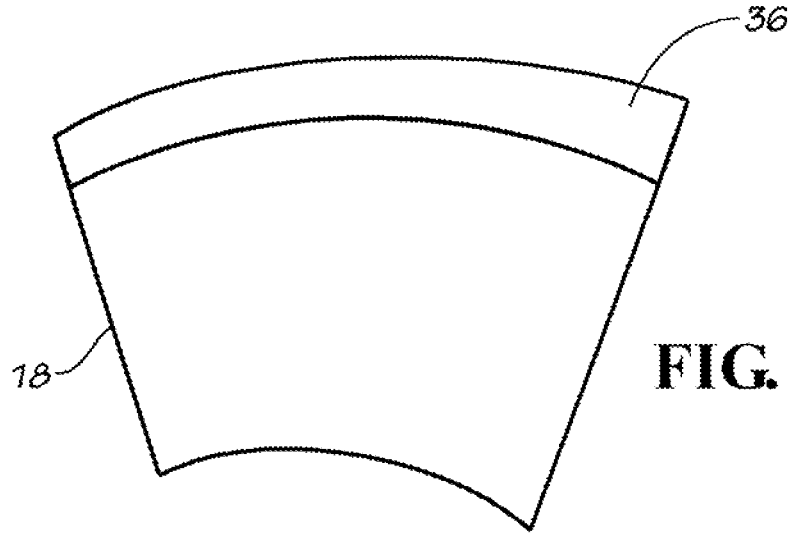
FIG. 6 is a plan view of a paperboard stock that forms the wall of a cup according to one embodiment of the invention.

In another embodiment, such as the one shown in FIG. 6, the upper portion 36 of the stock 18 used to form cup is made of a suitable plastic, such as polyethylene, polypropylene, polylactic acid (PLA), polyethylene terephthalate (PET), or any other biodegradable or non-biodegradable material. In this embodiment, the upper plastic portion 36 of the cup forms a plastic brim, while the wall of the cup is formed of paperboard. The brim in this embodiment serves as an adapter that interacts with the lid so that a separate adapter is not required. In alternate embodiments, instead of upper portion 36 being made of plastic, the entire stock 18 is coated more heavily.

In some embodiments, the outer diameter 30 of the upper portion of the adapter 12 is generally constant to interact with a single sized lid having a predetermined diameter. The inner diameter 28 of the lower portion of the adapter, however, varies depending on the size of the cup with which that particular adapter is to be used. Specifically, the outside of the inner diameter 28 of adapter 12 is sized to correspond to the upper diameter of the cup 14 with which it will be used. In some embodiments, including the embodiments where the adapter is affixed to the cup, the various sized cups and adapters can be sold as a single unit. The various sized cup and adapter units are all configured to interact with a lid having a predetermined diameter. Accordingly, an establishment supplying cups and lids is only required to carry one SKU for a lid having a predetermined diameter. Such lid is capable of fitting various sized cups by way of adapters preaffixed to the cups, with the adapters having various sized inner diameters that correspond to the upper diameter of the various sized cup.

Figure 7:
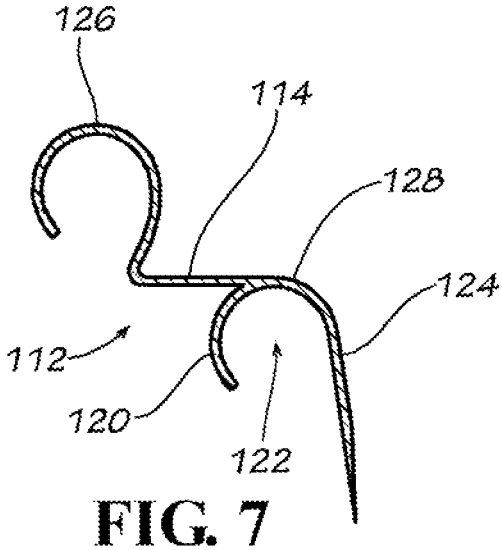
FIG. 7 is a cross-sectional plan view of an adapter according to another embodiment of the invention.
Figure 8:
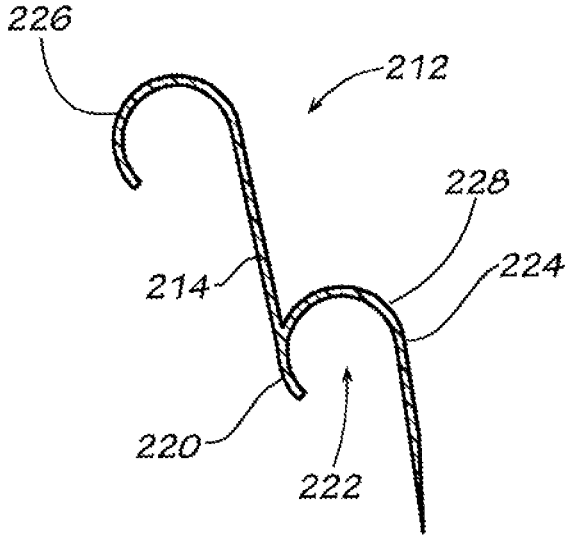
FIG. 8 is a cross-sectional plan view of an adapter according to another embodiment of the invention.
Figure 9:
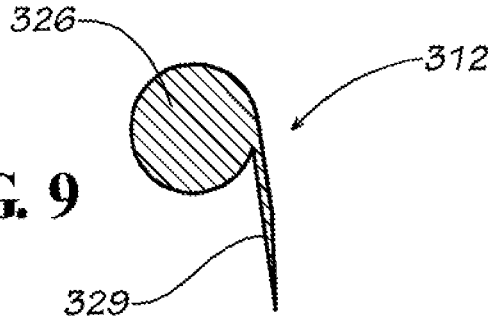
FIG. 9 is a cross-sectional plan view of an adapter according to another embodiment of the invention.
Figure 11:
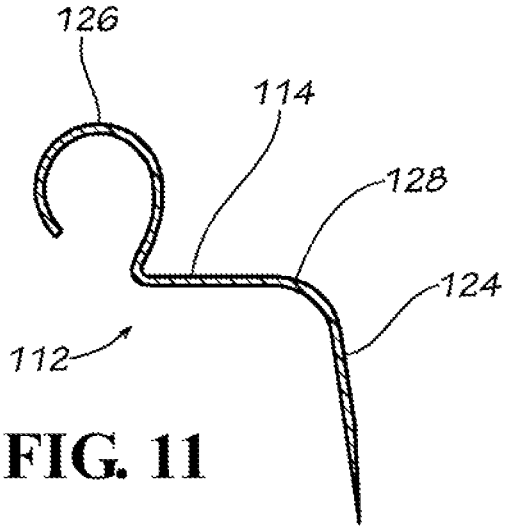
FIG. 11 is a cross-sectional plan view of an adapter according to another embodiment of the invention.

FIGS. 7-9 show alternate embodiments of adapter 12. FIG. 7 illustrates an adapter 112 having a stair step-type configuration. Adapter 112 includes a cup attachment portion 128, the cup attachment portion including a ledge 120 and a base portion 124. As described above, the base portion 124 is sized and shaped to fit within the upper portion of a cup. The ledge 120 is sized and shaped to form a gap 122 that receives a brim of a cup. FIG. 11 illustrates another embodiment where the adapter is configured to interact with an uncurled brim or a brimless cup, although it could also be used with cups having a brim, including curled or partially curled brims. Adapter 112 also includes a transition piece 114, as well as a lid attachment portion 126 that is sized and shaped to fit within an inner diameter of a lid that is snapped onto lid attachment portion 126. The length of transition piece 114 is adjusted to accommodate cups having various diameters. For instance, to fit a cup with a smaller diameter, the length of transition piece 114 of adapter 112 is increased.

Figure 12:
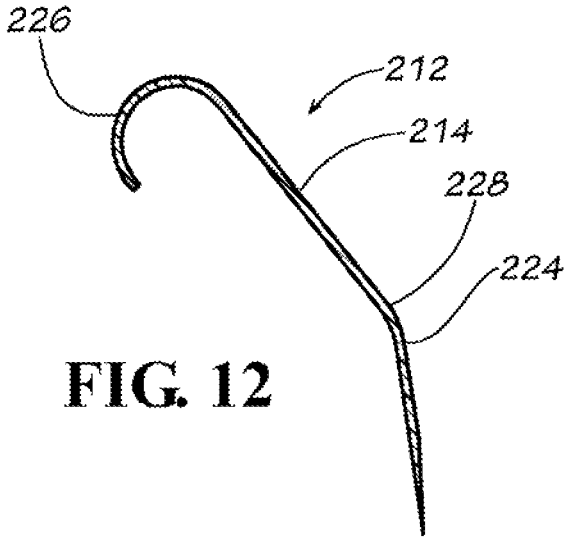
FIG. 12 is a cross-sectional plan view of an adapter according to another embodiment of the invention.

Like adapter 112 of FIG. 7, adapter 212 of FIG. 8 includes a cup attachment portion 228, the cup attachment portion 228 having a ledge 220 and a base portion 224. As described above, the base portion 124 is sized and shaped to fit within the upper portion of a cup. The ledge 220 is sized and shaped to form a gap 222 that receives a brim of a cup. The adapter 212 of FIG. 8 is similar to the adapter 112 of FIG. 7, except the transition piece 214 tapers from lid attachment portion 226 to cup attachment portion 228 instead of being a stair step-type configuration. FIG. 12 illustrates another embodiment where the adapter is configured to interact with an uncurled brim or a brimless cup, although it could also be used with cups having a brim, including curled or partially curled brims.

Figure 13:
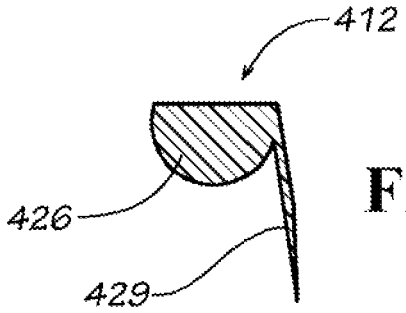
FIG. 13 is a cross-sectional plan view of an adapter according to another embodiment of the invention.

In some embodiments, cup does not include a brim around the upper periphery of the cup. In these embodiments, an adapter such as adapter 312 of FIG. 9 or adapter 412 of FIG. 13, or any other suitable adapter, may be used. Adapter 312 includes a base portion 329 that is configured to fit within the upper portion of the cup, and a brim portion 326 that is shaped and sized to receive a lid. Specifically, brim portion 326 is sized to correspond to an inner diameter of the lid, and shaped to correspond to the geometry of the interior of the lid so that it captures and secures the lid. Adapter 412 is similar to adapter 312 except it is formed of less material. Like adapter 312, adapter 412 includes a base portion 429 that is configured to fit within the upper portion of the cup, and a brim portion 426 that is shaped and sized to receive a lid.

Numerous modifications of this invention may be made in the composition, application, manufacturing process and other aspects of this invention without departing from the objectives and spirit of the description above and in the Figures. For example, as mentioned throughout the text, the adapter may be configured to work with cups of various shapes, sizes, and configurations, including cups having a brim or brimless cups. In cups having a brim, the brim may be either curled, partially curled, or uncurled.

The invention claimed is:

1. A system for adapting cups of various sizes to fit a single size lid, the system comprising:

a first adapter comprising an upper portion having a lid diameter and a base portion having a first diameter, a second adapter comprising an upper portion having a lid diameter and a base portion having a second diameter, wherein the lid diameter of the first and second adapters corresponds to an inner diameter of a lid so that the lid is configured to capture the upper portion of either the first adapter or second adapter;

wherein the first diameter of the first adapter is configured to correspond to a first upper diameter of a first cup so the first cup is configured to capture the base portion of the first adapter, wherein the second diameter of the second adapter is configured to correspond to a second upper diameter of a second cup so the second cup is configured to capture the base portion of the second adapter, wherein the first upper diameter of the first cup and the second upper diameter of the second cup are different, wherein each of the first and second cups further comprises a brim that extends around a periphery of an upper portion of each of the cups, and wherein each of the first and second adapters further comprises a ledge that extends around a periphery of the upper portion of each of the first and second adapters, wherein each of the first and second adapters further comprises a gap formed between the base portion of each of the first and second adapters and the ledge, and wherein the gap is shaped and sized to accommodate the brim of the cup.

2. The system of claim 1, wherein the lid diameter of the first and second adapters is slightly smaller than the inner diameter of the lid.

3. The system of claim 1, wherein the first diameter of the first adapter is slightly smaller than the first upper diameter of the first cup and the second diameter of the second adapter is slightly smaller than the second upper diameter of the second cup.

4. The system of claim 1, wherein the base portion of each of the first and second adapters is tapered.

5. The system of claim 1, wherein the first and second adapters are plastic.

6. The system of claim 1, wherein the first and second cups are formed of paper-based materials.

7. The system of claim 1, wherein each of the first and second adapters further comprises a transition piece having a stair-step configuration.

8. A system for adapting cups of various sizes to fit a single size lid, the system comprising:

a first adapter comprising an upper portion having a lid diameter and a base portion having a first diameter, a second adapter comprising an upper portion having a lid diameter and a base portion having a second diameter, wherein the lid diameter of the first and second adapters corresponds to an inner diameter of a lid so that the lid is configured to capture the upper portion of either the first adapter or second adapter;

wherein the first diameter of the first adapter is configured to correspond to a first upper diameter of a first cup so the first cup is configured to capture the base portion of the first adapter, wherein the second diameter of the second adapter is configured to correspond to a second upper diameter of a second cup so the second cup is configured to capture the base portion of the second adapter, wherein the first upper diameter of the first cup and the second upper diameter of the second cup are different, and wherein each of the first and second adapters further comprises a transition piece, the transition piece being tapered from a top portion to a bottom portion.

9. A kit of lid adapters comprising:

a first adapter having a lower portion having an inner diameter and an upper portion having an outer diameter, a second adapter having a lower portion having an inner diameter and an upper portion having an outer diameter that is substantially the same as the outer diameter of the upper portion of the first adapter, wherein the outer diameter of the upper portion of the first and second adapters is sized and shaped to cooperate with a lid, wherein the inner diameter of the lower portion of the first adapter and the inner diameter of the lower portion of the second adapter are different diameters, and wherein the inner diameter of the lower portion of the first adapter is configured to fit with a first cup, adapting the first cup to be sized to receive a lid having a diameter of about the outer diameter of the upper portion of the first and second adapters, wherein the inner diameter of the lower portion of the second adapter is configured to fit with a second cup, adapting the second cup to be sized to receive a lid having a diameter of about the outer diameter of the upper portion of the first and second adapters, allowing a single size lid to be used with cups having different diameter openings, and wherein the inner diameter of the first adapter and the inner diameter of the second adapter are both smaller than the outer diameter of the first and second adapters.

10. The kit of lid adapters of claim 9, wherein the outer diameter of the first and second adapters is slightly smaller than a diameter associated with the lid.

11. The kit of lid adapters of claim 9, wherein the inner diameter of the lower portion of the first adapter is slightly smaller than a diameter associated with the first cup, and the inner diameter of the lower portion of the second adapter is slightly smaller than a diameter associated with the second cup.

12. The kit of lid adapters of claim 9, wherein each of the first and second adapters further comprises a ledge that extends around a periphery of an upper portion of each of the first and second adapters.

13. The kit of lid adapters of claim 11, wherein each of the first and second adapters further comprises a gap formed between the lower portion of each of the first and second adapters and the ledge.

14. The kit of lid adapters of claim 13, wherein the gap of the first adapter is shaped and sized to accommodate a brim of the first cup, and wherein the gap of the second adapter is shaped and sized to accommodate a brim of the second cup.

15. The kit of lid adapters of claim 9, wherein the lower portion of each of the first and second adapters is tapered.

16. The kit of lid adapters of claim 9, wherein each of the first and second adapters further comprises a transition piece.

17. An adapter comprising:

(i) an upper portion comprising a ledge that extends around a periphery of the upper portion, the ledge comprising a lid diameter that corresponds to a set diameter of a lid;

(ii) a tapered base portion comprising a gap and having a base diameter, wherein the gap is shaped and sized to accommodate an upper portion of a sidewall of a cup and wherein the base diameter corresponds to the upper portion of the sidewall of the cup so that the base portion is configured to be retained by the upper portion of the sidewall of the cup; and (iii) a transition piece connecting the upper portion with the base portion;

wherein the upper portion of the adapter is receivable by a lid so that the adapter adapts cups of various sizes to receive the lid having the set diameter.

18. A system for adapting cups of various sizes to fit a single size lid, the system comprising:

a first adapter comprising an upper portion having a lid diameter and a base portion having a first diameter, a second adapter comprising an upper portion having a lid diameter and a base portion having a second diameter, wherein the lid diameter of the first and second adapters corresponds to an inner diameter of a lid so that the lid is configured to capture the upper portion of either the first adapter or second adapter; and wherein the first diameter of the first adapter is configured to correspond to a first upper diameter of a first cup so the first cup is configured to capture the base portion of the first adapter, wherein the second diameter of the second adapter is configured to correspond to a second upper diameter of a second cup so the second cup is configured to capture the base portion of the second adapter, wherein the first upper diameter of the first cup and the second upper diameter of the second cup are different, and wherein the base portion of each of the first and second adapters is tapered.

19. A kit of lid adapters comprising:

a first adapter having a lower portion having an inner diameter and an upper portion having an outer diameter, a second adapter having a lower portion having an inner diameter and an upper portion having an outer diameter, wherein the outer diameter of the upper portion of the first and second adapters is sized and shaped to cooperate with a lid, wherein the inner diameter of the lower portion of the first adapter and the inner diameter of the lower portion of the second adapter are different diameters, and wherein the inner diameter of the lower portion of the first adapter is configured to fit with a first cup, adapting the first cup to be sized to receive a lid having a diameter of about the outer diameter of the upper portion of the first and second adapters, wherein the inner diameter of the lower portion of the second adapter is configured to fit with a second cup, adapting the second cup to be sized to receive a lid having a diameter of about the outer diameter of the upper portion of the first and second adapters, allowing a single size lid to be used with cups having different diameter openings, wherein each of the first and second adapters further comprises a ledge that extends around a periphery of an upper portion of each of the first and second adapters, wherein each of the first and second adapters further comprises a gap formed between the lower portion of each of the first and second adapters and the ledge, and wherein the gap of the first adapter is shaped and sized to accommodate a brim of the first cup, and wherein the gap of the second adapter is shaped and sized to accommodate a brim of the second cup.

20. A kit of lid adapters comprising:

a first adapter having a lower portion having an inner diameter and an upper portion having an outer diameter, a second adapter having a lower portion having an inner diameter and an upper portion having an outer diameter, wherein the outer diameter of the upper portion of the first and second adapters is sized and shaped to cooperate with a lid, wherein the inner diameter of the lower portion of the first adapter and the inner diameter of the lower portion of the second adapter are different diameters, and wherein the inner diameter of the lower portion of the first adapter is configured to fit with a first cup, adapting the first cup to be sized to receive a lid having a diameter of about the outer diameter of the upper portion of the first and second adapters, wherein the inner diameter of the lower portion of the second adapter is configured to fit with a second cup, adapting the second cup to be sized to receive a lid having a diameter of about the outer diameter of the upper portion of the first and second adapters, allowing a single size lid to be used with cups having different diameter openings, wherein the lower portion of each of the first and second adapters is tapered.

* * * * *